United States Patent [19]

Austin

[11] 4,045,102

[45] Aug. 30, 1977

[54] CARD STORAGE AND DISPENSING DEVICE

[76] Inventor: Walter H. Austin, 2205 Harrison Ave., Everett, Wash. 98201

[21] Appl. No.: 669,830

[22] Filed: Mar. 24, 1976

[51] Int. Cl.[2] ..... A47F 01/12; A45C 11/18

[52] U.S. Cl. ..... 312/61; 206/39; 312/71

[58] Field of Search ..... 206/39.5, 39.6, 438; 312/35, 61, 71; 221/232, 245, 259, 268, 270, 279; 271/61 TR, 61 CS; 211/49 D

[56] References Cited

U.S. PATENT DOCUMENTS

| | | | |
|---|---|---|---|
| 457,581 | 8/1891 | Floyd | 312/61 |
| 3,308,989 | 3/1967 | Alltop et al. | 221/232 |
| 3,549,046 | 12/1970 | Iten | 221/232 |
| 3,710,929 | 1/1973 | Morales | 206/39.5 |
| 3,860,304 | 1/1975 | Bolton | 312/71 |

*Primary Examiner*—Casmir A. Nunberg

[57] ABSTRACT

A card storage and dispensing device for business cards comprises a cabinet, having a lower storage drawer with front and back triangular reinforcing pieces, provides open, center sides for finger engagement with the edges of cards. The cabinet rear wall is vertically adjustable toward and away from the cabinet front wall, providing therebetween an adjustable discharge slot for dispensing cards therethrough of varying thicknesses and one at a time. A forward portion of the top wall has a depending ledge preventing discharge of cards rearwardly therepast. A first removable bottom wall is supported by cabinet, side wall ledges, a spring one such wall resiliently urges a second removable wall, and cards thereon, upwardly and into frictional engagement with the bottom of the cabinet top wall. The bottom of such second wall carries a depending ledge engaging and removing the spring with its removal. The first and second walls and the spring are accessible through a slidingly mounted and removable upper cabinet door. A tiltable card-engaging finger is mounted for reciprocating movement on the cabinet top wall through a slot therein. This finger engages and discharges a card during its discharge motion and slides over the top card on its retractile movement. The underside advancing edge portion of the finger has a surface enhancing card engagement portion.

8 Claims, 7 Drawing Figures

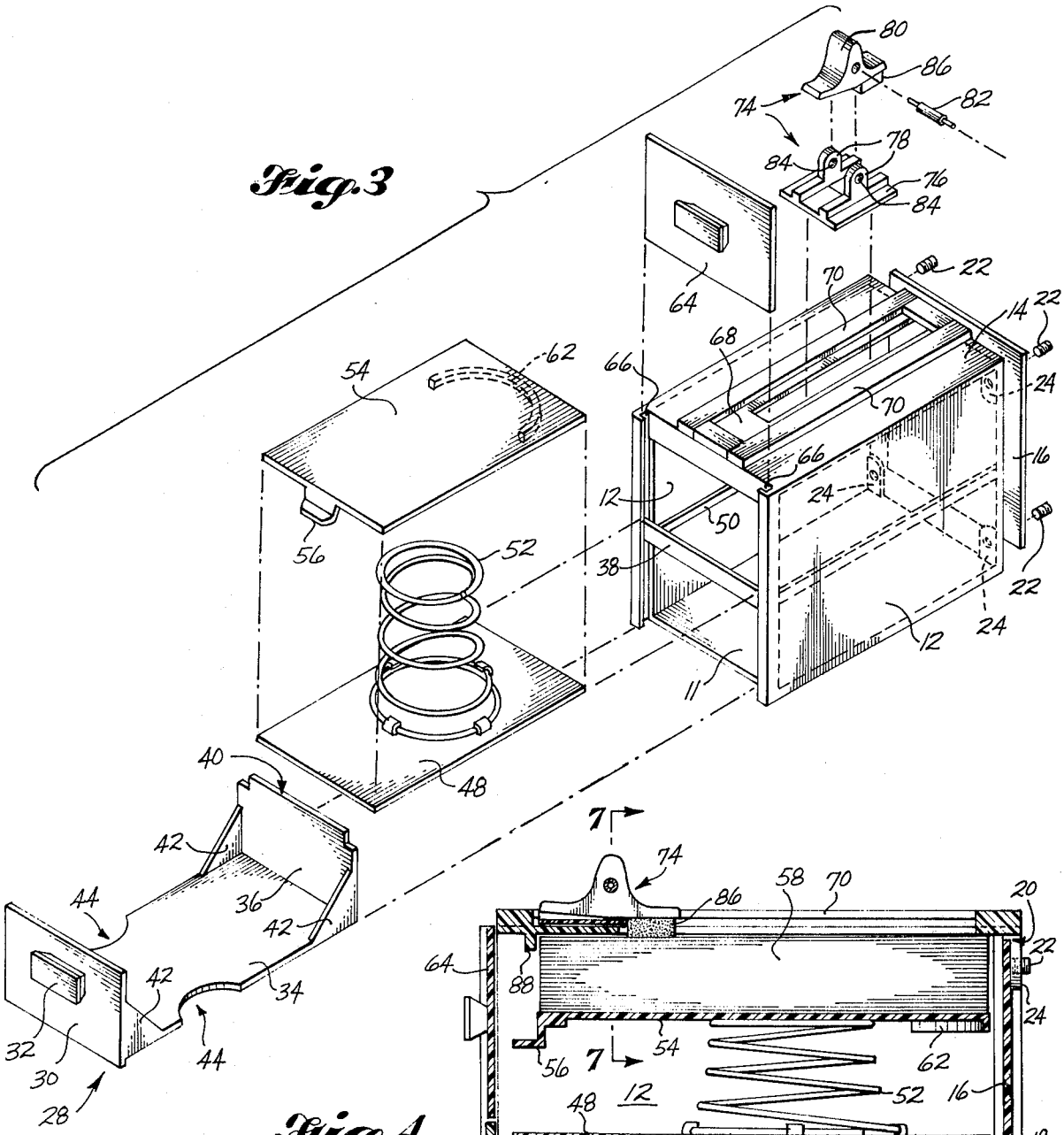
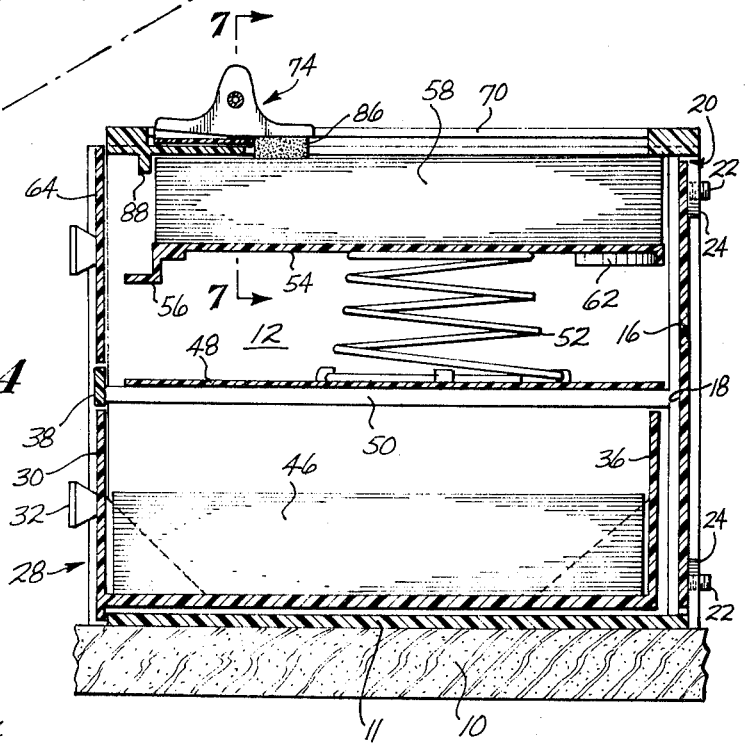
Fig. 4
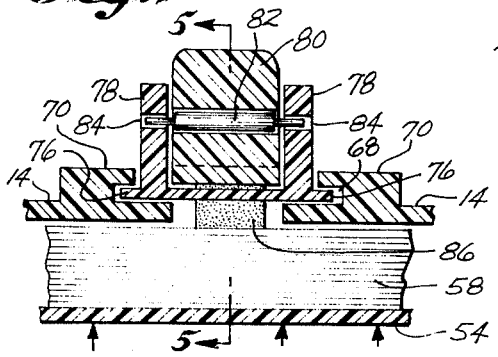

CARD STORAGE AND DISPENSING DEVICE

BACKGROUND OF THE INVENTION

It is essential to have business cards readily available on one's desk, when either the businessman senses that it would be to his advantage to provide a customer or potential customer with one and also when parties ask for one. There is a present need on the market for a desk dispenser of such cards which is neat and attractive in appearance and which efficiently operates to dispense cards, one at a time, and one which is proficient in dispensing cards even though cards commonly vary in thickness of stock.

The present state of the prior art is well illustrated by the following issued U.S. Letters Pat. Nos.

| | |
|---|---|
| 501,279 | 1,390,979 |
| 612,906 | 1,415,276 |
| 787,452 | 3,286,823 |
| 1,062,174 | 3,688,896 |
| 1,099,214 | 3,710,929 |
| 1,155,791 | |

SUMMARY OF THE INVENTION

In the preferred form of the invention, the card storage and dispenser device comprises a cabinet formed of durable and attractive material, as a colored plastic. The cabinet has a suitable and attractive base for the mounting and supporting of the cabinet and the utility of the base may be augmented by also mounting thereon additional instruments, as a fountain pen. The cabinet preferably comprises side walls secured to said base. A top wall, having a longitudinally extending slot, connects the side walls together. The rear wall is detachably connected to the side walls and the upper edge of the rear wall is adjustable, toward and away from the undersurface of the top wall, to provide an adjustable slot for the dispensing, through such slot, of cards, one at a time, and with the adjustment to provide for the dispensing of cards of different thicknesses.

The lower, approximately one-half portion of the cabinet mounts therein a sliding drawer for the storage of cards. This drawer has a front, bottom, and back wall. Triangular, side corner pieces connect between each side edge of the front wall and the bottom wall and each side edge of the rear wall and the bottom wall to reinforce the drawer and to cooperate with finger cutout in the bottom wall to facilitate ready removal and insertion of the cards into the storage drawer while maintaining finger engagement with the cards.

The approximate upper half of the cabinet mounts the cards to be dispensed and the dispensing mechanism. Each side wall carries a longitudinally extending edge means or runner on which a first bottom wall is slidably mounted. A compression spring, preferably in the form of a tapered helical coil rests on said first bottom wall and engages the undersurface of the second bottom wall and resiliently urges said second bottom wall and a stack of cards disposed thereon upwardly and with the upper surface of the topmost card engaging the undersurface of the top wall of the cabinet. The top surface of the upper card is available through the longitudinally extending slot in the top wall of the cabinet.

The second bottom wall has a finger engaging tab to provide for ready engagement thereof. Also, the rearward bottom surface of the second bottom wall is provided with a depending arcuate ridge so that, upon sliding removal of said second bottom wall, it will engage the spring and move the spring in a direction out of the cabinet.

Runners are mounted on the sides of the longitudinally extending top wall and the slide is mounted in said runners for reciprocating travel longitudinally of said slot. The slide carries a removable cross pin on which is tiltably mounted a finger actuating card-engaging member. The advancing underside portion of said card-engaging member is provided with a surface, as rubber, enhancing engagement with the top surface of the topmost card. During the card ejection travel direction of said card-engaging member, it is tilted downwardly and into card engagement and in the retractable direction, it passes over and out of engagement with the top surface of the top card.

Further objects, advantages, and details of my invention will become explicit or implicit as the description of my invention proceeds in connection with the accompanying drawings.

DESCRIPTION OF THE DRAWINGS

A more complete understnding of the invention may be had by reference to the accompanying drawings illustrating a preferred form of embodiment of my invention in which like reference numeral characters refer to like parts throughout the several views and in which:

FIG. 3 is an exploded perspective view showing the various parts of my invention;

FIG. 4 is a longitudinal sectional view taken substantially on broken line 4—4 of FIG. 1;

FIG. 7 is a fragmentary sectional view taken substantially on broken line 7—7 of FIG. 4.

DESCRIPTION OF A PREFERRED EMBODIMENT

Figure 1:
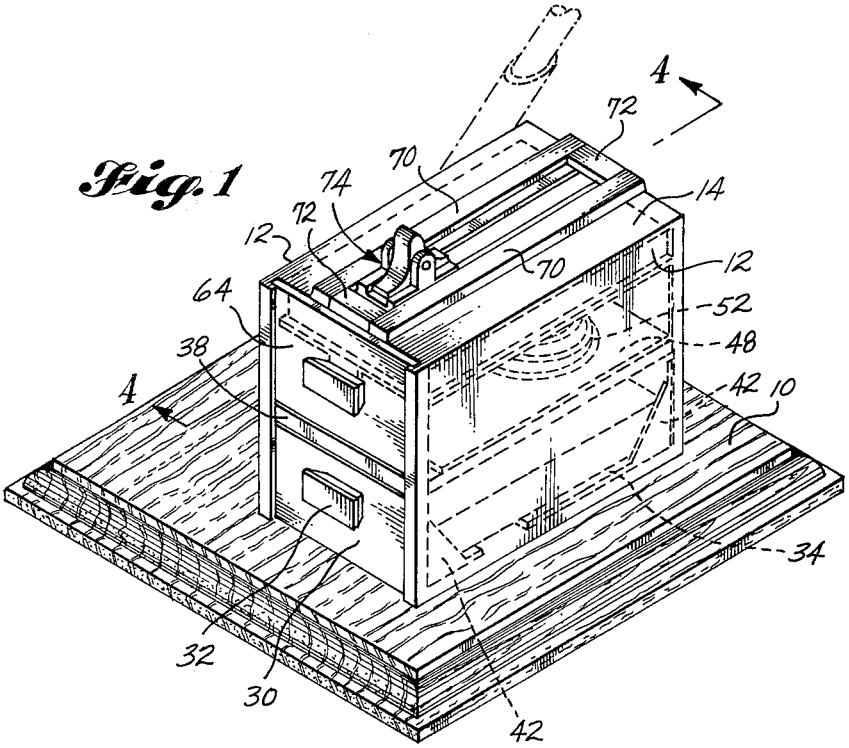
FIG. 1 is a perspective view taken from the front of the device showing my invention.
Figure 2:
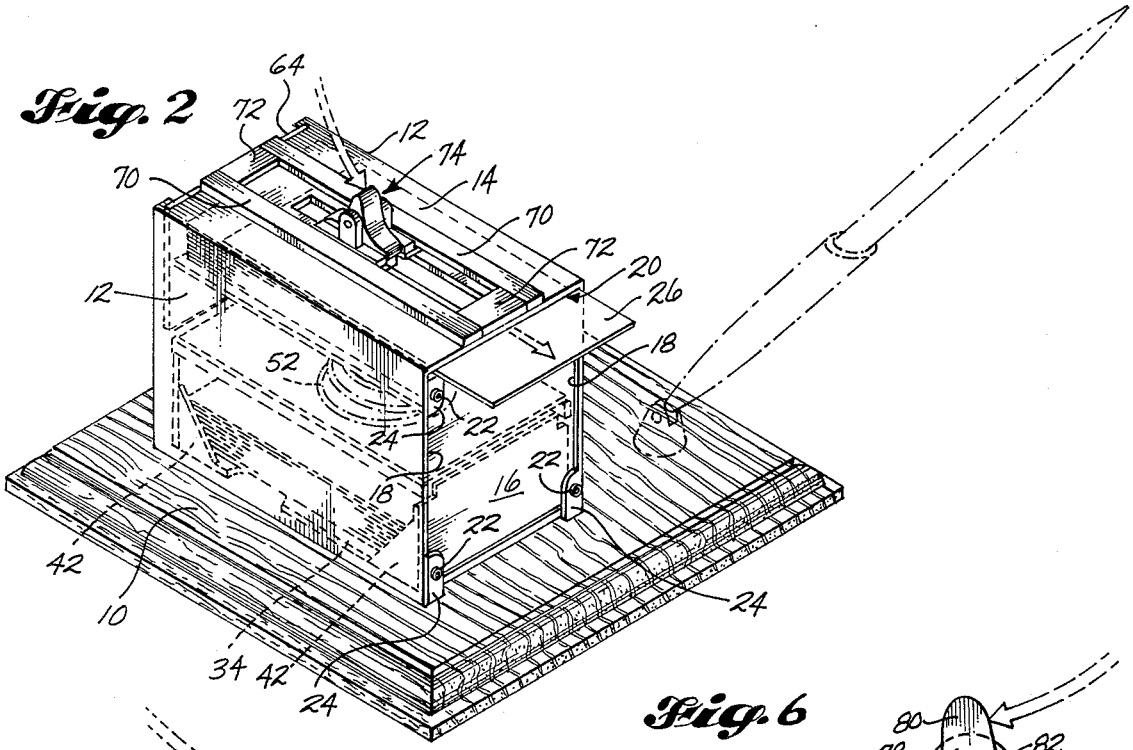
FIG. 2 is a perspective view taken toward the rear of the structure of FIG. 1.
Figure 5:
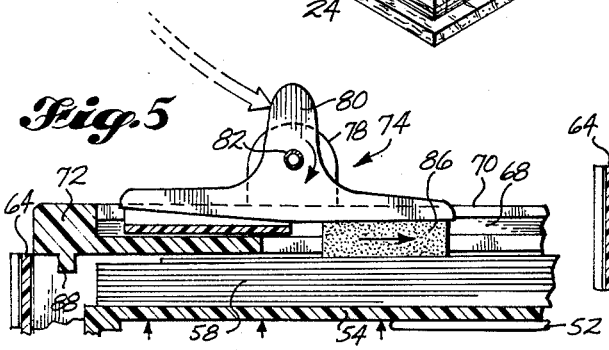
FIG. 5 is a fragmentary sectional view, on a larger scale, taken substantially on broken line 5—5 of FIG. 7, showing the action of finger actuated card-engaging member during card ejection.
Figure 6:
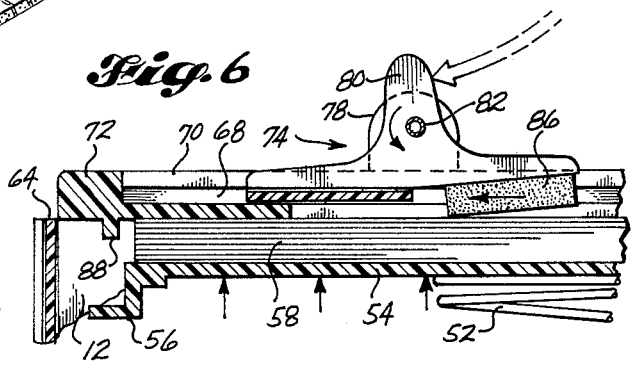
FIG. 6 is a view similar to FIG. 5 showing the action of the card-engaging member during its retractile motion.

A base 10 is a decorative piece and also functions to rigidly support a fixed bottom wall 11, which in turn cooperates with base 10 to support vertically disposed side walls 12. Also, bottom wall 11 functions to make the dispenser self contained so a selected base 10 may be used. Side walls 12 support a top wall 14. A rear wall 16 is slidable, vertically in grooves 18 in the rear vertical edges of side walls 12 to permit adjustment of the height of a discharge slot 20. An adjustment of such slot 20 is maintained by set screws 22 threaded in ears 24 carried by side walls 12 and which set screws 22 engage with rear wall 16. The size of the slot 20 is adjusted so that only one card at a time, illustrated by top card 26, may be ejected out of said discharge slot 20. In other words, business cards are often printed on stock of different thicknesses and this device is adjustable to take care of the ejection of cards regardless of the thickness of stock on which the cards are printed.

A sliding card storage drawer 28 slides between side walls 12 and over the fixed bottom wall 11. The drawer 28 has a decorative front wall 30 with a finger graspable handle 32 thereon, a bottom 34, and a rear wall 36. A cross brace 38 extends between and is connected with side walls 12. A rear wall 34 of the storage drawer 28 has an upwardly projecting stop 40 to engage with the inner surface of the cross brace 38 and stop sliding removal of the storage drawer 28. However, storage drawer 28 can be slidingly moved until the stop 40 almost engages the cross brace 38 and then the storage drawer 28 moved angularly, as is common with desk and cabinet drawers, and thus removed.

The sides of the front wall 30 and the sides of the rear wall 36 are interconnected with the bottom wall 34 by reinforcing triangular shaped pieces 42 and at locations removed from the finger receiving recesses 44 in the bottom wall 34 so that a stack of cards 46 may be inserted or removed as a stack and without finger interference from portions of the drawer 28.

A first bottom wall 48 is supported by ledges 50, with a ledge secured to each side wall 12 and at an elevation above the storage drawer 28 so as not to interfere with the operation thereof. The said first bottom wall 48 is slidingly mounted on said ledges 50 and is thus readily insertable or removable. A compression spring 52, preferably in the form of a tapered helix, is adhered or secured to the top surface of the first bottom wall 48 and thus is inserted or removed with said bottom wall 48.

A second bottom wall 54 is provided with a finger engagable tab 56 so it can be readily engaged for siding removal or insertion, despite the fact that on top of said second bottom wall 54 is disposed a stack of card 58 to be dispensed, one at a time, with the top card 26 thereof dispensed out through discharge slot 20. An arcuate depending ridge 62 is connected with the forward bottom surface of the second bottom wall 54 an thus engages with the forward end portion of the spring 52 if the second bottom wall 54 is slid outwardly when a spring 52 is in place on the first bottom wall 48, when the latter, in turn, is in place. A front door 64 is mounted for sliding movement into the grooves 66, one in each rear end portion of each side wall 12.

The top wall 14 is provided with a slot 68 extending longitudinally thereof. Two side rails 70 are disposed, one on each side of the slot 68, and two end pieces 72 complete the end assembly. The said rails 70 and end pieces 72 mount finger actuated card-engaging member, generally numbered 74 in FIG. 3, and more particularly the side edge portions of the base member 76 thereof. Pin supports 78 are secured to base member 76 and are spaced apart to mounted therebetween thumb lever/80 for free turning movement thereof. A spring-loaded cross pin 82 extends through openings 84 in pin supports 78 to pivotally support thumb lever 80. This spring-loaded cross pin 82 is of the type commonly used to connect a wrist watch to a strap and a similar connection is used to connect and disconnect the cross pin 82 and the openings 84. The forward under side of the thumb lever 80 is provided with a card-engaging surface, as a rubber member 86.

After the parts 70, 72, 74, 76, 78, 80, and 82 are in operative position, the rails 70 and end pieces 72 may be secured to the top wall member 14, as by gluing with an appropriate adhesive.

During ejection travel of the thumb lever 80, the forward end rubber portion 86 is pushed downwardly upon tilting of the thumb lever 80 and it engages the top surface of the top card 26 and dispenses the same out discharge slot 20. During retractile movement, the rubber end portion 86 is raised above the top surface of the top card 26 upon tilting of said thumb lever 80 and it slides therepast without engagement. Thus, the said end rubber 86 is ready for its next forward excursion to contact the top surface of the top card 26 and dispense the same out discharge slot 20. A stop or depending lug 88 is disposed in the path of travel of cards toward door 64 and thus prevents travel of a top card 26 in this direction.

SUMMARY

It will now be apparent that I have provided a card storage and dispensing device comprising a cabinet having vertically disposed side walls 12 and a vertically disposed front wall which may be in the nature of the front wall 30 of the storage drawer 28 and sliding door 64. Next is provided a vertically disposed rear wall 16 and a horizontally disposed bottom wall means, which may be in the nature of the fixed bottom wall 11. The horizontally disposed top wall 14, along with the previously mentioned walls, provide a card enclosure for receiving a stack of cards therein to be dispensed one at a time. The upper edge of the rear wall 16 being spaced below and in close relation to the bottom surface of the top wall 14 providing a discharge slot 20 therebetween through which a single upper card 26 may be dispensed. The upper top wall 14 is provided with a longitudinally disposed guide slot 68. A finger actuated card-engaging member 74 is mounted on said guide slot 68. A finger actuated, card-engaging member 86 is mounted for traveling movement in the groove 66 to engage the top surface of the top card 26 of a stack of cards 58 during one direction of travel of the member 86 and to slide over said top card 26 in the other direction of travel of the rubber finger 86.

The rear vertical wall 16 is slidingly mounted by detachable means, as ears or lugs 24 which are detachably carried by the vertical side walls 12 and thus the rear wall 16 is removable.

The bottom wall means may include not only fixed bottom wall 11, but also include a first bottom wall 48 and a second bottom wall 54 and the supporting means for the first bottom wall means 48 which would include the ledges 50 carried by the side walls 12. Thus, the first removable bottom wall 48 is slidingly mounted on ledges 50 and a second removable bottom wall 54 is urged upwardly by spring means 52, which is shown preferably in the form of a tapered helix. A stack of cards to be dispensed 46 are positioned on the second bottom wall 54 and are resiliently urged upwardly by the spring 52, disposed between first bottom wall 48 and second bottom wall 54. Also, the topmost card 26 of the stack of cards 58 is urged into frictional engagement with the bottom surface of the top wall14.

The base 10 supports the side walls 12 and the rear wall 16 and the first bottom wall 18 is elevated above the base 10 and is supported by the side walls 12 through ledges 50. Thus is provided a storage compartment and in said storage compartment is disposed a card storage drawer 28 which is preferably a sliding drawer.

The sliding drawer 28 comprises a front wall 30, a bottom wall 34, and a rear wall 36. Two triangular pieces 42 connect the front wall 30 with the bottom wall 34 and two triangular pieces 42 connect the rear wall 36 with the bottom wall 34 which thus permit cards to be picked up by their center side portions for insertion and removal from said card storage drawer 28.

There is also provided a front wall which comprises the sliding door 64 mounted in grooves 66 in the side walls 12.

Regarding the card-engaging means, there is provided a card-engaging member comprising a slide member 74 mounted in the slide guide 68 in the top wall 14 which includes the tiltable finger piece or thumb lever 80 having a lower end portion, as rubber 86, movable into and out of engagement with the upper surface of the topmost card 26 in the stack of cards 46 in the cabinet. The pivot means comprises the spring-loaded pin means 82 which is carried by the slide member and which pin means is disposed crosswise of the dispenser slot 68.

Preferably, the rear wall 16 of the cabinet is adjustably mounted relative to the top wall 14 so as to provide adjustment of the size of the discharge slot 20 to accommodate cards of different thicknesses so that only one card will be dispensed at a time regardless of the thickness of the card stock.

Also, the second bottom wall 54 preferably has a depending arcuate ridge 62 to engage the top of coil spring 52 when the second bottom wall 54 is slidingly removed.

In order to ensure that the top card 26 can be only moved in a direction toward discharge slot 20, preferably a ledge or depending projection 88 is disposed in the path of the top card 26 in the direction toward the front wall door 64. Thus, even if attempt were made to improperly operate thumb lever 80, the topmost card 26 could not be urged past said ridge 88.

Obviously, changes may be made in the dimensions, arrangements, and the parts of my invention without departing from the principle thereof, the above setting forth only a preferred form of embodiment of my invention.

I claim:

1. A card storage and dispensing device comprising a cabinet having vertically disposed side walls, a vertically disposed front wall, a vertically disposed rear wall, a horizontally disposed bottom wall means, and a horizontally disposed top wall, said walls forming a card enclosure for receiving a stack of cards to be dispensed, one at a time, the upper edge of said rear wall being spaced below and in close spaced relation to the bottom surface of said top wall providing a discharge slot therebetween through which a single card may be dispensed, said top wall having a central, longitudinally disposed, dispenser guide slot therein; a slide guide means mounted on said guide slot; and a finger actuated, card-engaging member mounted for sliding traveling movement in said slide guide means to engage the surface of the top card of a stack of cards in one direction of its travel and to slide over said top card in its other direction of travel, said card-engaging member comprising a slide member mounted on said slide guide means, a tiltable finger-engaging piece having a lower end portion movable into and out of engagement with the upper surface of the topmost card of said stack of cards in said card enclosure, and pivot means carried by said slide member and positioned crosswise of the dispenser guide slot.

2. The combination of claim 1, wherein said bottom wall means comprises spaced apart ledge means carried by said side walls, a first bottom wall supported by and slidingly mounted on said ledge means, a second bottom wall means on which the stack of cards may be positioned and compression coil spring means supported by said first bottom wall and resiliently urging upwardly said second bottom wall and cards supported thereby, into frictional engagement with the bottom surface of the top wall.

3. The combination of claim 1, wherein a base is provided for said side walls, rear walls, and bottom wall means and is provided with a storage compartment having a card storage drawer therein, said drawer comprising front, bottom and rear walls, two triangular pieces connecting the front wall to the bottom wall and two triangular pieces connecting the rear wall to the bottom wall, permitting cards to be picked up by their center side portions for insertion and removal from said drawer.

4. The combination of claim 1, wherein the front wall also comprises the front of said drawer.

5. The combination of claim 1, wherein said lower end portion of the finger-engagable piece is formed of rubber.

6. The combination of claim 1, wherein the rear wall of the cabinet is detachably connected with the side walls and is adjustable mounted relative to the top wall providing for adjustment of said discharge slot through which single cards of different thicknesses may be dispensed.

7. The combination of claim 2, wherein said second bottom wall means has a depending arcuate ridge to engage the top of the coil spring when the second bottom wall is slidingly removed.

8. The combination claim 1, wherein the top wall carries a depending ledge preventing discharge of said card in a direction toward the rear end vertical wall.

* * * * *